US011499781B2

(12) United States Patent
Motomura et al.

(10) Patent No.: US 11,499,781 B2
(45) Date of Patent: Nov. 15, 2022

(54) CONCENTRATE BURNER OF COPPER SMELTING FURNACE AND OPERATION METHOD OF COPPER SMELTING FURNACE

(71) Applicant: PAN PACIFIC COPPER CO., LTD., Tokyo (JP)

(72) Inventors: Tatsuya Motomura, Oita (JP); Yuki Soma, Oita (JP)

(73) Assignee: PAN PACIFIC COPPER CO., LTD., Tokyo (JP)

( * ) Notice: Subject to any disclaimer, the term of this patent is extended or adjusted under 35 U.S.C. 154(b) by 309 days.

(21) Appl. No.: 16/634,004

(22) PCT Filed: Aug. 23, 2017

(86) PCT No.: PCT/JP2017/030193
§ 371 (c)(1),
(2) Date: Jan. 24, 2020

(87) PCT Pub. No.: WO2019/038866
PCT Pub. Date: Feb. 28, 2019

(65) Prior Publication Data

US 2021/0088283 A1 Mar. 25, 2021

(51) Int. Cl.

| | |
|---|---|
| ***F27D 3/18*** | (2006.01) |
| ***C22B 5/02*** | (2006.01) |
| ***C22B 15/00*** | (2006.01) |
| ***F27D 3/16*** | (2006.01) |

(52) U.S. Cl.
CPC ..... *F27D 3/18* (2013.01); *C22B 5/02* (2013.01); *C22B 15/0052* (2013.01); *F27D 2003/168* (2013.01)

(58) Field of Classification Search
CPC ..... F27D 3/18; F27D 2003/168; C22B 5/02; C22B 15/0052
See application file for complete search history.

(56) References Cited

U.S. PATENT DOCUMENTS

| | | | | |
|---|---|---|---|---|
| 8,986,421 | B2 * | 3/2015 | Sipila | F27B 15/14 75/330 |
| 2001/0049982 | A1 | 12/2001 | Hirai et al. | |
| 2014/0239560 | A1 | 8/2014 | Lahtinen et al. | |

FOREIGN PATENT DOCUMENTS

| | | | |
|---|---|---|---|
| JP | 58-141347 | A | 8/1983 |
| JP | 2001-247922 | A | 9/2001 |
| JP | 2003-64427 | A | 3/2003 |

(Continued)

OTHER PUBLICATIONS

Japanese Office Action for counterpart Japanese Application No. 2020-009125, dated Mar. 9, 2021, with English translation.

(Continued)

*Primary Examiner* — Scott R Kastler
(74) *Attorney, Agent, or Firm* — Birch, Stewart, Kolasch & Birch, LLP

(57) ABSTRACT

A concentrate burner provided over a reaction shaft of a copper smelting furnace, is characterized by comprising: a raw material supply portion that supplies a starting material into the reaction shaft, the starting material including copper concentrate; and an additive supply portion that is provided separately from the raw material supply portion and supplies solid additive to the starting material.

6 Claims, 6 Drawing Sheets

(56) References Cited

FOREIGN PATENT DOCUMENTS

| | | | |
|---|---|---|---|
| JP | 2005-8965 | A | 1/2005 |
| JP | 2014-533781 | A | 12/2014 |

OTHER PUBLICATIONS

Decision of Refusal issued in counterpart Japanese Patent Application No. 2016-114644 dated Oct. 23, 2019.
International Search Report (PCT/ISA/210) issued in PCT/JP2017/030193, dated Nov. 7, 2017.
Notice of Reasons for Refusal issued in Japanese Patent Application No. 2016-114644, dated Jan. 8, 2019.
Written Opinion of the International Searching Authority (PCT/ISA/237) issued in PCT/JP2017/030193, dated Nov. 7, 2017.
International Preliminary Report on Patentability, dated Mar. 5, 2020 and English Translation of the Written Opinion of the International Searching Authority (Forms PCT/IB/338, PCT/IB/373 & PCT/ISA/237) dated Nov. 7, 2017, for International Application No. PCT/JP2017/030193.

* cited by examiner

CONCENTRATE BURNER OF COPPER SMELTING FURNACE AND OPERATION METHOD OF COPPER SMELTING FURNACE

TECHNICAL FIELD

The present invention relates to a concentrate burner of copper smelting furnace and an operation method of a copper smelting furnace.

BACKGROUND ART

Recently, a material to be treated in a copper smelting tends to be shifted from a material that is mainly composed of copper concentrate to a material of which a high profit material ratio is increased. However, it was not possible to deal with degradation of an operation (degradation of a slag loss) caused by the shifting. When a high margin material is treated, a generation amount of a hardly meltable substance of which a main component is magnetite ($Fe_3O_4$) increases in a furnace. However, a mechanism is not specified. It is possible only to deal with degradation of a furnace condition after the condition is degraded. In a condition that it is not possible to change a mixing ratio of materials, there are no other effective solving means. The degradation of the operation is forced for a long time. Therefore, a profit is greatly degraded.

There is disclosed a method for dealing with a furnace blocking, increase of an intermediate layer and so on that are caused by a peroxide slag ($Fe_3O_4$ or the like) generated by degradation of a gas phase and a solid phase reaction in a reaction shaft, as a conventional technology (for example, see Patent Document 1). However, in the technology, the furnace blocking and the increase of the intermediate layer are dealt with after the phenomena occur. An effect is small in the operation condition that the high margin material is increased. Therefore, the technology does not sufficiently deal with the phenomena.

PRIOR ART DOCUMENT

Patent Document

PATENT DOCUMENT 1: Japanese Patent Application Publication No. 2005-8965

SUMMARY OF THE INVENTION

Problems to be Solved by the Invention

Through a study by the present inventors, it is found out that the hardly meltable substance mainly composed of $Al_2O_3$ and $Fe_3O_4$ tends to be generated when an $Al_2O_3$ concentration in slag increases because of an Al (aluminum) source in a raw material. And it is found out that a slag loss increases when a separation of matte and slag is degraded. However, there are no effective means for dealing with increase of Al in a raw material.

It is thought that solid additive is supplied into a copper smelting furnace together with a raw material, in order to suppress influence of increasing of Al in the raw material. It is thought that the raw material is mixed with the solid additive in advance and the mixed raw material and the solid additive is supplied into a reaction shaft via a concentrate burner, when the solid additive is supplied into the copper smelting furnace together with the raw material.

However, when the raw material and the solid additive are mixed in advance, it may not be necessarily capable of immediately stopping the supply of the solid additive, even if a defect occurs in the furnace and stopping of the supply of the solid additive is requested. It is difficult to control supplying of the solid additive, because the solid additive and the raw material are mixed with each other and are lying in wait before the concentrate burner. It is difficult to promptly change a supply amount of Fe to an appropriate value in accordance with an analyzed value of generated slag, even if a concentration of $Al_2O_3$ in the generated slag is higher than a concentration of $Al_2O_3$ estimated during the mixing because of uneven distribution of the raw material composition or the like.

The present invention was made to solve the above problem, and the object thereof is to provide a concentrate burner of a copper smelting furnace and an operation method of a copper smelting furnace that are capable of controlling supply of solid additive.

Means for Solving the Problems

A concentrate burner provided over a reaction shaft of a copper smelting furnace of the present invention, is characterized by comprising: a raw material supply portion that supplies a starting material into the reaction shaft, the starting material including copper concentrate; and an additive supply portion that is provided separately from the raw material supply portion and supplies solid additive to the starting material. An additive inlet of the additive supply portion may be in the raw material supply portion or on a downstream side of the raw material supply portion. An additive inlet of the additive supply portion may be provided in a chute that is provided over the raw material supply portion. The additive inlet of the additive supply portion may be provided in a dispersion cone, wherein the dispersion cone may be provided at a bottom of a lance, wherein the lance may pass through the raw material supply portion and form a passage for blowing dispersion gas for dispersing the starting material, into the copper smelting furnace. The solid additive may be Fe metal source.

An operation method of a copper smelting furnace of the present invention, the furnace including a concentrate burner that has a raw material supply portion for supplying a starting material into a reaction shaft, an additive supply portion that is provided separately from the raw material supply portion and supplies solid additive to the starting material, the concentrate burner being provided over the reaction shaft, is characterized by including: supplying the solid additive to a position that is in the raw material supply portion or on a downstream side of the raw material supply portion, separately from the starting material, via the additive supply portion. The solid additive may be Fe metal source.

Effects of the Invention

According to the concentrate burner of the copper smelting furnace and the operation method of the copper smelting furnace of the present invention, it is possible to control supply of solid additive.

MODES FOR CARRYING OUT THE INVENTION

In the following, a description will be given of the best mode for carrying out the present invention.

Embodiment

Figure 1:
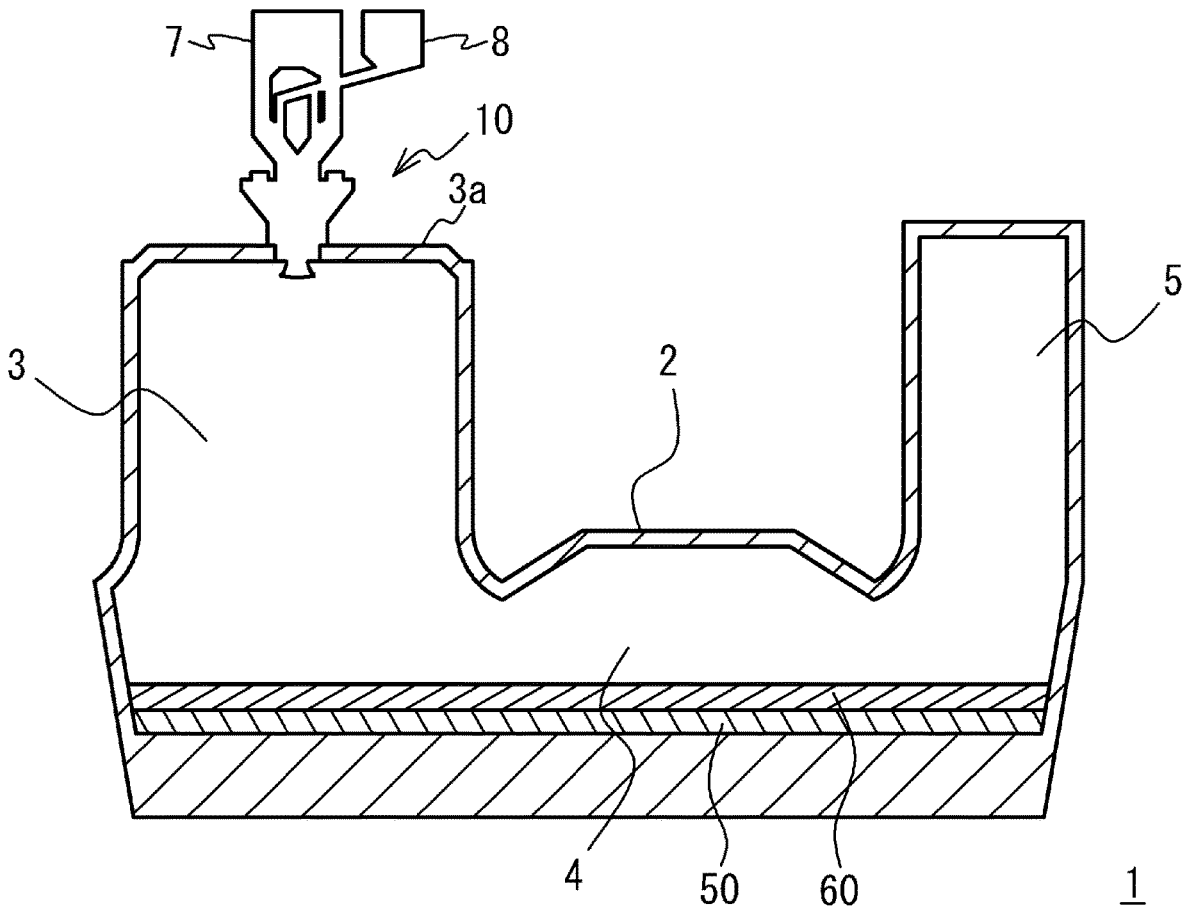
FIG. 1 illustrates a schematic view of a smelting furnace used in an embodiment of a copper-smelting method.

FIG. 1 illustrates a schematic view of a flash smelting furnace (hereinafter referred to as a smelting furnace) 1 used in an embodiment of a copper-smelting method. As illustrated in FIG. 1, the smelting furnace 1 has a furnace body 2. The furnace body 2 has a structure in which a reaction shaft 3, a settler 4 and an uptake 5 are arranged in this order. A concentrate burner 10 is provided on an upper part 3*a* of the reaction shaft 3. The smelting furnace 1 of the embodiment is a copper smelting furnace.

In the copper smelting using the smelting furnace 1, reaction gas including oxygen is supplied into the reaction shaft 3 through the concentrate burner 10 together with a raw material for copper-smelting such as copper concentrate, a flux, a recycle raw material and so on (hereinafter, these solid materials are referred to as a starting material). Thus, the raw material for copper-smelting causes an oxidation reaction on the basis of the following reaction formula (1) or the like. And, as illustrated in FIG. 1, matte 50 and slag 60 are separated from each other on the bottom of the reaction shaft 3. In the following reaction formula (1), $Cu_2S.FeS$ acts as a main component of the matte. $FeO.SiO_2$ acts as a main component of the slag. Silicate ore is used as the flux.

$$CuFeS_2+SiO_2+O_2 \rightarrow Cu_2S.FeS+2FeO.SiO_2+SO_2+\text{reaction heat} \quad (1)$$

For example, it is possible to use oxygen rich air as the reaction gas. The oxygen rich air is air having an oxygen concentration larger than that in a natural atmosphere. For example, the oxygen rich gas has an oxygen concentration of 60 volume % to 90 volume %. Therefore, the raw material for copper-smelting can cause sufficient oxidation reaction. The reaction gas of the embodiment is supplied into the reaction shaft 3, as main gas for reaction and auxiliary gas for reaction, as described in detail later.

For example, the raw material for copper-smelting includes Cu: 26 mass % to 32 mass %, Fe: 25 mass % to 29 mass %, S: 29 mass % to 35 mass %, $SiO_2$: 5 mass % to 10 mass %, and $Al_2O_3$: 1 mass % to 3 mass %. For example, copper concentrate having a large amount of Al includes Cu: 24 mass % to 30 mass %, Fe: 23 mass % to 28 mass %, S: 29 mass % to 35 mass %, $SiO_2$: 7 mass % to 12 mass % and $Al_2O_3$: 3 mass % to 7 mass %.

$Al_2O_3$ reacts with FeO and forms a complex oxide ($FeAl_2O_4$) and dissolves in magnetite ($Fe_3O_4$). In this case, magnetite spinel is formed because of existence of $Al_2O_3$. And, $Fe_3O_4$ is stabilized. Thereby, an amount of solid $Fe_3O_4$ increases in a molten metal. Fluidity of the slag is degraded. And a slag loss tends to increase because isolation between the slag and the matte is degraded. When the molten metal and an Fe metal coexist and an oxygen potential is reduced, oxidation of FeO is suppressed. And, an allowable concentration of $Al_2O_3$ in the slag 60 increases. Thereby, the formation of the complex oxide ($FeAl_2O_4$) and $Fe_3O_4$ is suppressed.

On the basis of the knowledge, in order to reduce the slag loss, it is necessary to increase the allowable concentration of $Al_2O_3$ in the slag 60 when the concentration of $Al_2O_3$ in the raw material for the copper smelting increases. On the other hand, it is difficult to suppress the formation of the complex oxide ($FeAl_2O_4$) even if the Fe metal is supplied in the slag 60 after the formation of the matte 50 and the slag 60. And it is necessary to adjust the supply position of the Fe metal. And so, in the embodiment, an Fe metal source including the Fe metal and acting as solid additive is mixed with the starting material before supplied in the reaction shaft 3.

Figure 2:
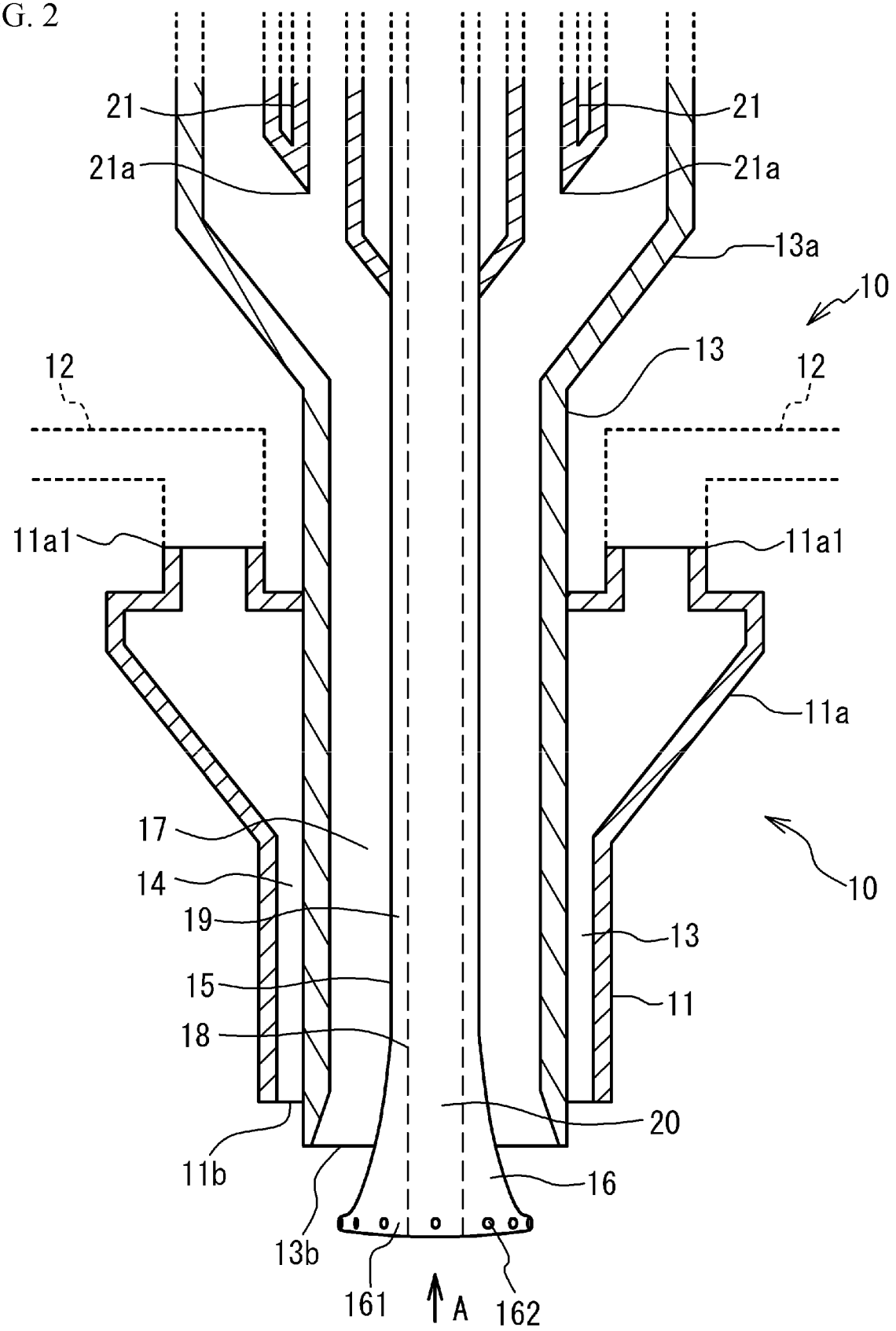
FIG. 2 schematically illustrates a concentrate burner of an embodiment.
Figure 3:
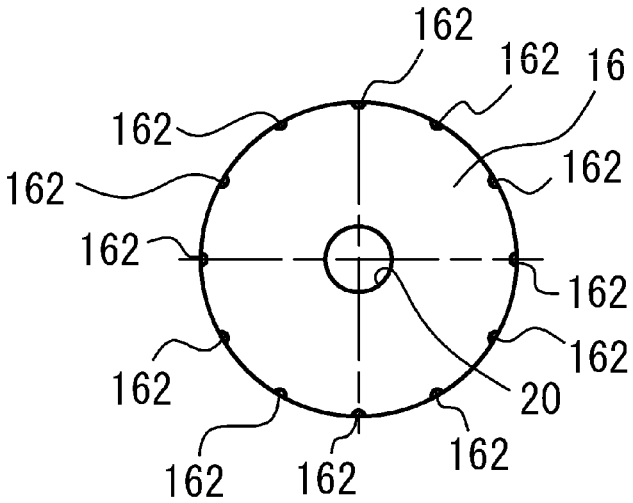
FIG. 3 illustrates a dispersion cone viewed from A side of FIG. 2.
Figure 4:
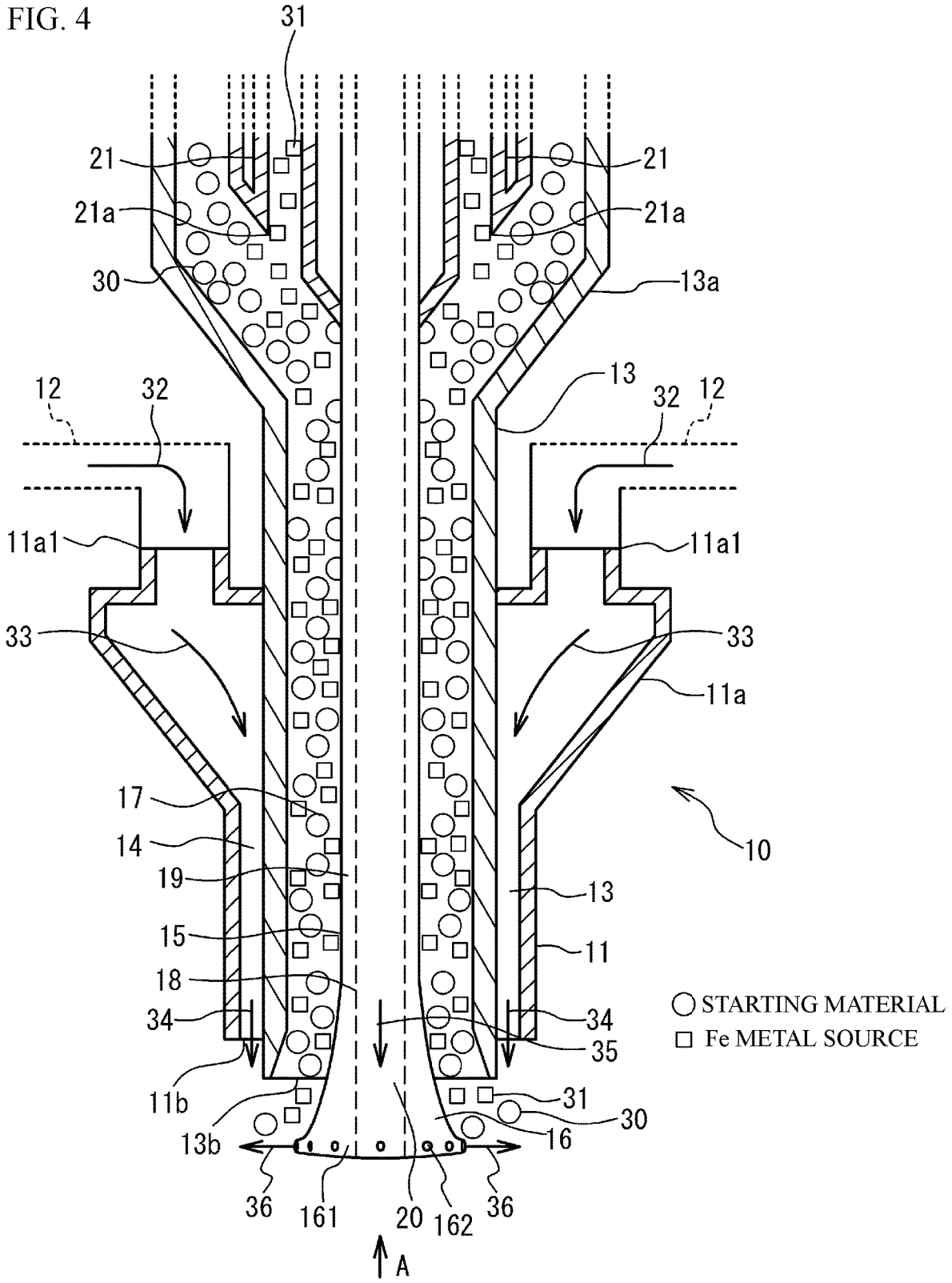
FIG. 4 schematically illustrates a case where a starting material and Fe metal source are supplied from a concentrate burner of an embodiment.

A description will be given of the concentrate burner 10 that is capable of supplying Fe metal source to the starting material supplied into the reaction shaft 3, on the basis of FIG. 2 to FIG. 4. FIG. 2 schematically illustrates the concentrate burner of the embodiment. FIG. 3 illustrates a dispersion cone viewed from A side of FIG. 2. FIG. 4 schematically illustrates a case where the starting material and the Fe metal source are supplied from the concentrate burner of the embodiment. The concentrate burner 10 is provided in the upper part 3*a* of the reaction shaft 3, as mentioned above. The concentrate burner 10 supplies main gas for reaction, auxiliary gas for reaction, and gas for dispersion (also contributing to the reaction) in addition to the starting material and the Fe metal source to the furnace body 2.

As illustrated in FIG. 2, the concentrate burner 10 has an air guide 11. The air guide 11 has a funnel-shaped portion 11*a* having an air inlet 11*a*1. An air pipe 12 is connected to the air inlet 11*a*1. In FIG. 4, the main gas for reaction is supplied to the funnel-shaped portion 11*a* as indicated with an arrow 32. The main gas for reaction guided to the air guide 11 is introduced into the reaction shaft 3 via a blowing inlet 11*b*, as indicated with arrows 33 and 34.

The concentrate burner 10 has a raw material supply portion 13. The raw material supply portion 13 has a chute 13*a* forming one or more of inclined passages on the raw material supply portion 13. The starting material stored in a hopper 7 provided above the concentrate burner 10 is supplied to the chute 13*a*. A bottom portion of the raw material supply portion 13 has a cylindrical shape. The raw material supply portion 13 is provided so as to pass through the air guide 11. An outer circumference face of the bottom portion of the raw material supply portion 13 forms a first passage 14 together with an inner circumference face of the air guide 11. The first passage 14 is a passage through which the main gas for reaction passes. The starting material in the raw material supply portion 13 is supplied in the reaction shaft 3 via an outlet 13*b* provided at a bottom of the raw material supply portion 13.

The concentrate burner 10 has a lance 15. A dispersion cone 16 is formed at an edge of the lance 15. The lance 15 is structured with a cylindrical member and is provided inside of the raw material supply portion 13. The outer circumference face of the lance 15 forms a second passage 17 together with an inner circumference face of the raw material supply portion 13. The second passage 17 is a passage through which the starting material flows downward.

An auxiliary air guide 18 having a cylindrical shape is provided inside of the lance 15. An outer circumference face of the auxiliary air guide 18 forms a third passage 19 together with an inner circumference face of the lance 15. The gas for dispersion passes through the third passage 19. The auxiliary air guide 18 having the cylindrical shape forms a fourth passage 20. The fourth passage 20 is a passage through which the auxiliary gas for reaction passes, as indicated with an arrow 35 in FIG. 4.

The dispersion cone 16 has a hollow truncated cone. As illustrated in FIG. 3, a plurality of supplying holes 162 for ejecting the gas for dispersion having passed through the third passage 19 into the reaction shaft 3 are formed at a bottom side face 161. As illustrated in FIG. 3, the supplying holes 162 are radially arranged in the dispersion cone 16. As illustrated in FIG. 4, the supplying holes 162 are formed so as to eject the gas for dispersion toward outward in a radius direction of the bottom face of the dispersion cone 16, as indicated with an arrow 36. Moreover, the supplying holes 162 eject the gas for dispersion in a direction intersecting with a normal direction of the bottom face of the dispersion cone 16. Thus, the reaction between the concentrate and the reaction gas is complicated early. The reaction is equalized. And a progress speed of the reaction is kept approximately constant.

The concentrate burner 10 has an additive supply portion 21. The additive supply portion 21 is separately provided from the raw material supply portion 13. The additive supply portion 21 supplies the Fe metal source as solid additive added to the starting material. The additive supply portion 21 is connected to a hopper 8 provided above the additive supply portion 21. The Fe metal source stored in the hopper 8 is supplied to the additive supply portion 21. An additive inlet 21*a* of the additive supply portion 21 is formed in the raw material supply portion 13 or on the downstream side of the raw material supply portion 13. In the embodiment, the additive inlet 21*a* of the additive supply portion 21 of the concentrate burner 10 is provided in the chute 13*a* provided above the raw material supply portion 13. Thus, the Fe metal source is mixed with the starting material in the raw material supply portion 13 or on the downstream side of the raw material supply portion 13.

As illustrated in FIG. 4, a starting material 30 exists alone on the upstream side of the chute 13*a*. On the other hand, Fe metal source 31 exists alone in the additive supply portion 21. And, the Fe metal source is supplied to the raw material supply portion 13. That is, the Fe metal source joins the flow of the starting material, via the additive inlet 21*a* formed in the chute 13*a* included in the concentrate burner 10. Thus, the Fe metal source is mixed with the starting material.

In this manner, the Fe metal source 31 acting as solid additive is supplied to a position which is in the concentrate burner 10 or on the downstream side of the concentrate burner 10, separately from the starting material 30. Thus, the following effect is achieved.

For example, it is possible to immediately stop supplying of the Fe metal source 31, when a defect occurs in the furnace body 2 and the supplying of the Fe metal source to the reaction shaft 3 is requested. It is thought that the starting material 30 is mixed with the Fe metal source 31 in advance, the mixed starting material and the Fe metal source is transferred to the concentrate burner by a conveyor or the like and is supplied to the reaction shaft 3, when the Fe metal source is supplied to the reaction shaft 3 together with the starting material 30. However, when the starting material 30 and the Fe metal source 31 are mixed in advance, the Fe metal source 31 mixed with the starting material 30 in advance is mounted on the conveyor or the like and is lying in wait on the conveyor before the concentrate burner. It is therefore difficult to control the supplying of the Fe metal source 31. When the concentrate burner 10 of the embodiment is used, it is possible to control supplying of the Fe metal source 31. For example, it is possible to immediately stop the supplying of the Fe metal source 31. And it is possible to continue only the supplying of the starting material 30. Thereby, it is possible to continue stable operation while damage of the furnace body is suppressed, even if thermal burden increases in the furnace body. And, when the increasing of the thermal burden in the furnace body 2 settles, it is possible to restart the supplying of the Fe metal source 31. And, it is possible to promptly and appropriately adjust the supply amount of Fe according to an analyzed value of generated slag, when a concentration of $Al_2O_3$ in the generated slag gets higher than an estimated concentration of $Al_2O_3$ during mixing of the starting material 30 and the Fe metal source 31.

When the concentrate burner 10 of the embodiment is used, it is possible to frequently adjust the supply amount of the Fe metal source 31. For example, it is possible to adjust the supply amount of the Fe metal source 3 by adding the $Al_2O_3$ concentration in the starting material or the generated slag or the operation condition in the furnace body 2.

When the concentrate burner 10 is used, it is possible to achieve reduction of slag loss, maintaining of tap characteristic of molten metal, and stable continuing of the operation.

The additive inlet 21*a* of the additive supply portion 21 is formed in the raw material supply portion 13 or on the downstream side of the raw material supply portion 13 provided in the concentrate burner 10, when the flowing direction of the starting material 30 is focused on. Therefore, as illustrated in FIG. 5 and FIG. 6, an additive inlet 25*a* may be formed on an edge of the dispersion cone 16.

Figure 5:
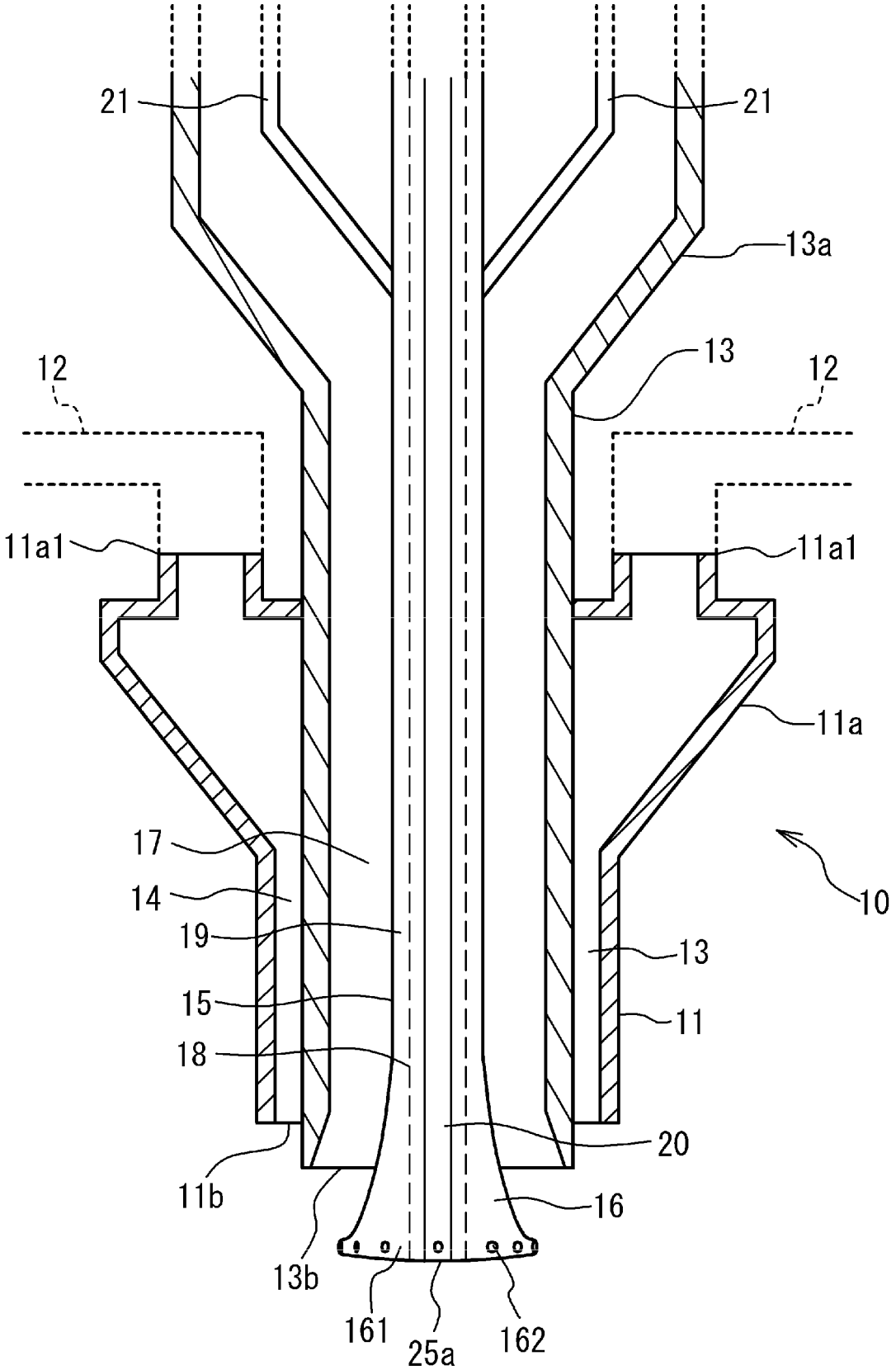
FIG. 5 schematically illustrates a concentrate burner of another embodiment.
Figure 6:
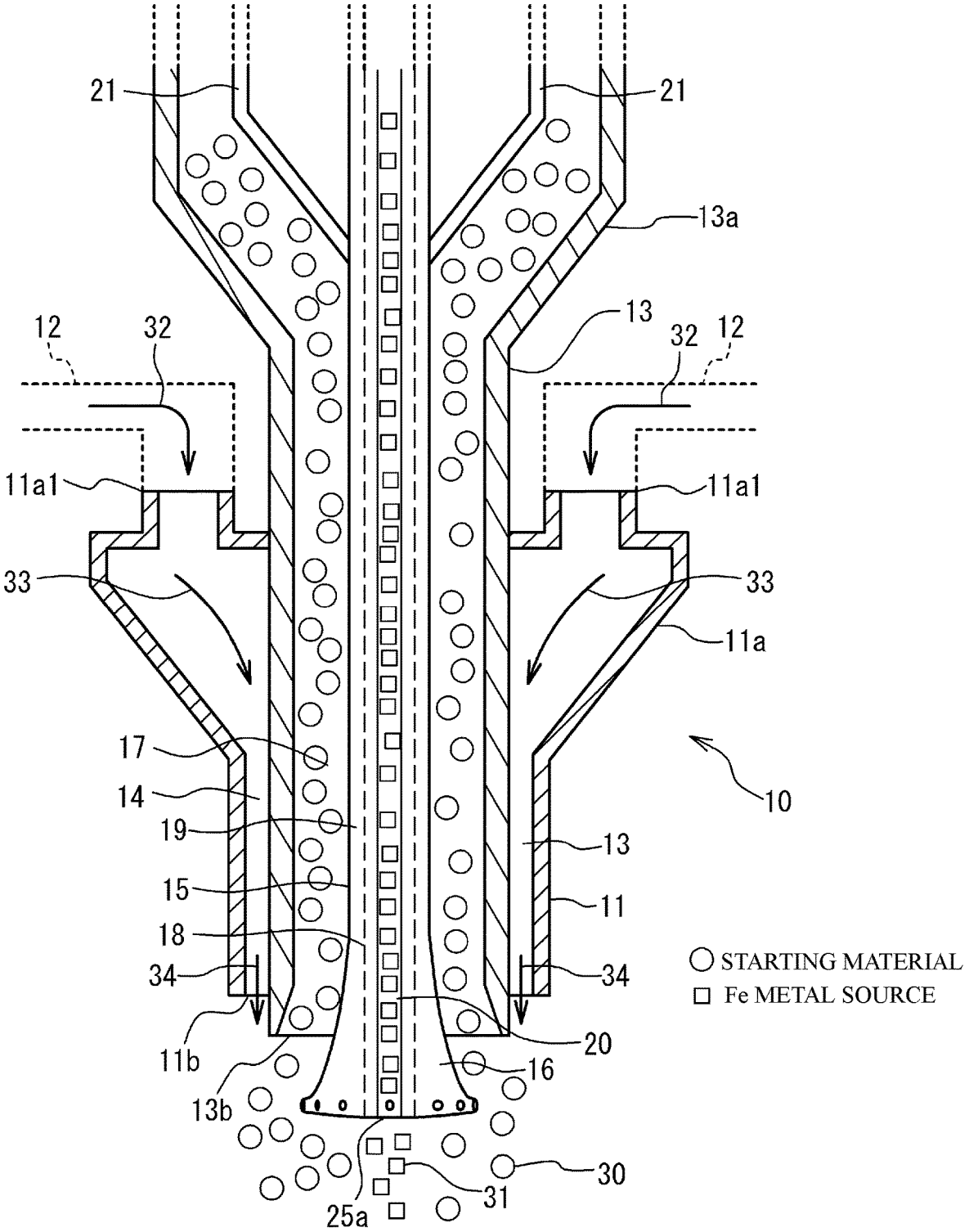
FIG. 6 schematically illustrates a case where a starting material and Fe metal source are supplied via a concentrate burner of another embodiment.

In concrete, instead of the additive supply portion 21 of FIG. 2, an additive supply portion 25 having a cylindrical shape may be provided in the auxiliary air guide 18 illustrated in FIG. 5 and FIG. 6. When the additive supply portion 25 is provided, the Fe metal source 31 contacts to liquid of the matte 50 and the slag 60 which are just generated in the reaction shaft 3 and have a high temperature, and the Fe metal source 31 is supplied to the molten metal. That is, the Fe metal source 31 supplied from the additive inlet 25*a* formed on the edge of the dispersion cone 16 contacts to the molten metal just below the dispersion cone 16. Even if the additive supply portion 25 is provided, it is possible to control the supplying of the Fe metal source 31. Both of the additive inlet 21*a* and the additive inlet 25*a* may be formed.

A material including an Fe metal of 40 mass % to 100 mass % is used as the Fe metal source. Pig iron or the like may be used as the Fe metal. When the pig iron is used, high reduction effect by the Fe metal is achieved, compared to a case where a recycle material or the like of which an amount of Fe component is small is used. A material including an Fe metal of 50 mass % to 60 mass % may be used, as the Fe metal source.

When a particle diameter of the Fe metal in the Fe metal source is excessively small, the Fe metal is oxidized and burns in the reaction shaft 3 because of oxygen in the reaction gas. In this case, the reduction effect may be degraded. On the other hand, when the particle diameter of the Fe metal is excessively large, the Fe metal may settles down to a furnace bottom before achieving the reduction effect. And a phenomenon dedicated to reduction of the furnace bottom may occur. And so, it is preferable that the particle diameter of the Fe metal in the Fe metal source is within a predetermined range. For example, it is preferable that the particle diameter of the Fe metal in the Fe metal source is 1 mm to 10 mm.

Fe metal groups having a particle diameter different from each other may be mixed and used as the Fe metal source. For example, when an amount of $Al_2O_3$ in the slag 60 in the furnace exceeds 4.5 mass % and the starring material causing increase of the amount is used, 40 mass % of a first Fe metal group having particle size distribution of 5 mm to 10 mm and 60 mass % of a second Fe metal group having particle size distribution of 1 mm to 5 mm may be mixed with each other, and a supply amount of the first Fe metal group and the second Fe metal group may be 120 kg/h. This is because an oxygen potential of a generated molten metal can be kept at a low value, and slag of which an $Al_2O_3$ amount is large can be reduced by suspending a relatively large size Fe metal in the slag 60 existing in the furnace. When an $Al_2O_3$ amount of the slag 60 in the furnace is less than 4 mass % but an $Al_2O_3$ amount of slag to be generated is going to exceed 4.5 mass %, 20 mass % of a first Fe metal group having particle size distribution of 5 mm to 10 mm and 80 mass % of a second Fe metal group having particle size distribution of 1 mm to 5 mm may be mixed with each other and a supply amount of the first Fe metal group and the second Fe metal group may be 60 kg/h. A main reason is that the oxygen potential in the molten metal just after generated can be kept at a lower value.

Another Fe metal group of which a particle diameter is other than 1 mm to 10 mm may be mixed. For example, an amount of a first Fe metal group of which a particle diameter is 1 mm to 10 mm may be 80 mass % in the Fe metal source, and an amount of a second Fe metal group of which a particle diameter is 10 mm to 15 mm may be 20 mass % in the Fe metal source. And the both of the first Fe metal group and the second Fe metal group may be mixed.

A description will be given of a case where carbon powder is used instead of the Fe metal. When the carbon powder is used, the carbon powder burns earlier than the copper concentrate in the reaction shaft 3. A contribution ratio of the carbon powder as a thermal compensation material increases. Therefore, an effect for suppressing the formation of $Fe_3O_4$ in the slag is small. Although it is thought that a reduction effect is achieved with use of a large amount of the carbon powder, an excessive reaction thermal amount occurs and a thermal load increases. An excessive amount of oxygen is consumed. A treatment amount of the copper concentrate is reduced. And reduction occurs in production. Moreover, there is a restriction of a gas supply amount in a post-process. Therefore, the treatment amount of the copper concentrate is reduced, and reduction occurs in production. A combustion heat of cokes that does not contribute to the reduction and burns causes increase of thermal load of the furnace. This results in a factor of a dissolved loss trouble such as a water-cooling jacket for cooling the furnace or the like.

On the other hand, when the granular Fe metal is used, the granular Fe metal drops and is in touch with a droplet of the matte 50 and a droplet the slag 60 that are just generated in the reaction shaft 3 and have a high temperature. The Fe metal is included in the molten metal. And it is possible to suppress the formation of $Fe_3O_4$ caused by $Al_2O_3$. It is thought that the influence of the reduction becomes larger than the influence of $Al_2O_3$ and the formation of $Fe_3O_4$ is suppressed, when the Fe metal and the molten metal that is just generated and has a high temperature coexist and a reduction degree is increased.

When granular carbon or block carbon is used, reduction of a specific surface area causes reduction of combustion efficiency of the carbon in the reaction shaft 3. Therefore, the carbon reaches the molten metal in the furnace. However, the granular carbon or the block carbon floats on a surface layer of the molten metal because of a specific gravity difference. Only the surface layer of the slag 60 is reduced. The contribution degree of the carbon to the whole of the slag 60 is low. The effect of reducing the influence of $Al_2O_3$ becomes smaller. On the other hand, when the Fe metal of which a particle diameter is adjusted is used, the oxidation combustion of the Fe metal caused by the reaction gas is suppressed, and settlement of the Fe metal to the furnace bottom is suppressed. Thus, the effect of the suppression of the $Fe_3O_4$ formation by the Fe metal is enhanced.

It is preferable that the supply amount of the Fe metal source is determined in accordance with the amount of $Al_2O_3$ to be formed in the slag 60. It is possible to estimate the amount of $Al_2O_3$ to be formed in the slag 60, from the amount of $Al_2O_3$ in the starting material. Because the recycle material in the starting material includes Al or $Al_2O_3$, the amount of $Al_2O_3$ (amount of Al) is considered. In the following description, the $Al_2O_3$ concentration (mass %) in the starting material is a concentration in which Al included in the starting material (for example, the recycle material) is converted into $Al_2O_3$ and is summed.

The concentration of $Al_2O_3$ in the slag fluctuates in accordance with a mixing ratio of the starting material. However, the concentration of $Al_2O_3$ in the slag is approximately 1.7 times to 2.0 times as the concentration of $Al_2O_3$ in the starting material. For example, when the concentration of $Al_2O_3$ in the starting material is 2.2 mass %, the concentration of $Al_2O_3$ in the slag is approximately 4.3 mass %. On the basis of the fact, it is preferable that the supply amount of the Fe metal source is 0 kg/h to 20 kg/h, when the supply amount of the starting material (except for repeated dust) is 130 t/h to 230 t/h (for example, 208 t/h), the supply amount of oxygen rich air as the reaction gas of which an oxygen concentration is 70 volume % to 82 volume % is 640 $Nm^3$/min to 700 $Nm^3$/min, and it is predicted that $Al_2O_3$ in the slag generated when $Al_2O_3$ in the starting material is 2.2 mass % or less is 4.2 mass % or less. It is preferable that the supply amount of the Fe metal source is 20 kg/h to 42 kg/h, when it is predicted that $Al_2O_3$ in the slag generated when $Al_2O_3$ in the starting material is 2.2 mass % or more and 2.4 mass % or less is 4.2 mass % or more and 4.5 mass % or less by calculation from the $Al_2O_3$ amount in the starting material. It is preferable that the supply amount of the Fe metal source is 42 kg/h to 105 kg/h, when it is predicted that $Al_2O_3$ in the slag generated when $Al_2O_3$ in the starting material is 2.4 mass % or more and 2.5 mass % or less is 4.5 mass % or more and 4.7 mass % or less by calculation from the $Al_2O_3$ amount in the starting material. It is preferable that the supply amount of the Fe metal source is 105 kg/h to 147 kg/h, when it is predicted that $Al_2O_3$ in the slag generated when $Al_2O_3$ in the starting material is 2.5 mass % or more and 2.6 mass % or less is 4.7 mass % or more and 5.0 mass % or less by calculation from the $Al_2O_3$ amount in the starting material. It is preferable that the supply amount of the Fe metal source is 147 kg/h to 160 kg/h, when it is predicted that $Al_2O_3$ in the slag generated when $Al_2O_3$ in the starting material is 2.6 mass % or more and 2.7 mass % or less is 5.0 mass % or more and 5.2 mass % or less by calculation from the $Al_2O_3$ amount in the starting material.

The concentration of $Al_2O_3$, $Fe_3O_4$, Cu or the like in the slag to be generated may be confirmed by analyzing slag extracted from the smelting furnace 1 or slag extracted from a slag cleaning furnace. For example, it is possible to adjust the operation with higher accuracy, by sampling the generated slag every one hour, confirming the $Al_2O_3$ concentration in the slag by a rapid analysis using XRF or the like in real time, and feed-backing the Fe metal supply amount to the slag to a setting value of an Fe metal supply equipment.

In the embodiment, the Fe metal source of which the Fe metal amount is 40 mass % to 100 mass % is supplied into the copper smelting furnace together with the starting material including the flux and the copper concentrate including Al. Thereby, the oxidation of FeO is suppressed, and the allowable concentration of $Al_2O_3$ in the slag is enlarged. It is therefore possible to suppress the slag loss. For example, it is preferable that the Fe metal source is supplied into the copper smelting furnace together with the starting material causing an $Al_2O_3$ concentration in the slag generated by supplying the starting material into the copper smelting furnace is to be more than 4.0 mass %. Alternatively, when the $Al_2O_3$ concentration in the slag generated by supplying the starting material through the concentrate burner 10 exceeds 4.0 mass %, the Fe metal source may be supplied into the copper smelting furnace together with another starting material to be supplied after that. It is preferable that the Fe metal source is supplied into the copper smelting furnace together with the starting material when the $Al_2O_3$ concentration in the starting material exceeds 2.0 mass %.

Example

[Example] The copper smelting furnace was operated in accordance with the embodiment. Table I shows an operation condition and results. From a first day to 13th day, an average supply amount of the starting material was 200 t/h, and the Fe metal source was not supplied. From 14th day, the average supply amount of the starting material was 208 t/h. The average supply amount of the Fe metal source was 42 kg/h. The Fe metal source was supplied through the concentrate burner after mixing with the starting material in advance. The Fe metal source included Fe metal of 55 mass % to 65 mass %. The supply amount of the oxygen rich air was 650 $Nm^3$/min to 690 $Nm^3$/min.

From the first day to the 13th day, when the $Al_2O_3$ concentration in the starting material increases, the $Al_2O_3$ concentration in the slag exceeded 4.5 mass %. This resulted in the slag loss of 1% or more. This is because a high allowable concentration of $Al_2O_3$ was not achieved with respect to the slag and $Fe_3O_4$ was stabilized because of the existence of $Al_2O_3$. On the other hand, from the 14th day, the $Al_2O_3$ concentration in the slag kept at a high value of 4.3 mass % or more (maximum was 4.7 mass %). However, it was possible to keep the slag loss at a low value that was approximately 0.8. This is because the generation of $Fe_3O_4$ was suppressed, and the allowable concentration of $Al_2O_3$ in the slag was high. From the 14th day, it was possible to suppress increasing of the intermediate layer in the flash furnace and the intermediate layer in the slag cleaning furnace.

TABLE 1

| | $Al_2O_3$ OF SLAG (mass %) | SLAG LOSS OF Cu (%) | INTERMEDIATE LAYER OF FLASH FURNACE (mm) | INTERMEDIATE LAYER OF SLAG CLEANING FURNACE (mm) | |
|---|---|---|---|---|---|
| 1ST DAY | 3.79 | | 90 | | |
| 2ND DAY | 3.90 | 0.710 | 65 | 250 | |
| 3RD DAY | 3.86 | 0.630 | 118 | 250 | |
| 4TH DAY | 3.90 | 0.800 | 124 | 250 | |
| 5TH DAY | 4.03 | 0.810 | 100 | 150 | |
| 6TH DAY | 4.05 | 0.775 | 100 | 100 | |
| 7TH DAY | 4.40 | 0.800 | 63 | 54 | |
| 8TH DAY | 4.05 | 0.750 | 85 | 142 | |
| 9TH DAY | 4.40 | 0.980 | 125 | 150 | |
| 10TH DAY | 4.72 | 1.026 | 233 | 200 | |
| 11TH DAY | 4.65 | 1.021 | 277 | 200 | |
| 12TH DAY | 4.54 | 0.952 | 308 | 234 | |
| 13TH DAY | 4.14 | 0.828 | 283 | 194 | |
| 14TH DAY | 4.19 | 0.841 | 233 | 170 | ↓SUPPLY OF Fe METAL |
| 15TH DAY | 4.70 | 0.875 | 225 | 150 | |
| 16TH DAY | 4.31 | 0.841 | 133 | 142 | |
| 17TH DAY | 4.17 | 0.775 | 133 | 100 | |
| 18TH DAY | 4.33 | 0.818 | 100 | 125 | |
| 19TH DAY | 4.25 | 0.778 | 113 | 104 | |
| 20TH DAY | 4.55 | 0.802 | 150 | 100 | |
| 21TH DAY | 4.46 | 0.839 | 150 | 100 | |
| 22TH DAY | 4.42 | 0.792 | 128 | 100 | |
| 231H DAY | 4.63 | 0.860 | 123 | 100 | |
| 24TH DAY | 4.35 | 0.854 | 150 | 100 | |
| 25TH DAY | 4.65 | 0.831 | 155 | 100 | |
| 26TH DAY | 4.16 | 0.862 | 165 | 100 | |
| 27TH DAY | 4.25 | 0.841 | 112 | 103 | |

Although the embodiments of the present invention have been described in detail, it is to be understood that the various change, substitutions, and alterations could be made hereto without departing from the spirit and scope of the invention.

The invention claimed is:

1. A concentrate burner provided over a reaction shaft of a copper smelting furnace, comprising:

a raw material supply portion having a first passage that extends in a vertical direction and supplies a starting material into the reaction shaft via the first passage, the starting material including copper concentrate;

a chute that is provided over the raw material supply portion, is inclined with respect to the first passage, and supplies the starting material to the first passage; and an additive supply portion that is provided separately from the raw material supply portion and has a second passage for supplying a reducing agent to the starting material of the chute, wherein the second passage is connected to the chute over the raw material supply portion.

2. The concentrate burner of the copper smelting furnace as claimed in claim 1, further comprising:

a hopper that is provided above the additive supply portion and is connected to the additive supply portion, wherein Fe metal source is stored in the hopper, as the reducing agent.

3. An operation method of a copper smelting furnace, the furnace including a concentrate burner that has a raw material supply portion having a first passage that extends in a vertical direction and supplying a starting material including copper concentrate into a reaction shaft via the first passage, a chute that is provided over the raw material supply portion, is inclined with respect to the first passage, and supplies the starting material to the first passage, and an additive supply portion that is provided separately from the raw material supply portion and has a second passage for supplying a reducing agent to the starting material of the chute, the concentrate burner being provided over the reaction shaft, the second passage being connected to the chute over the raw material supply portion, the method comprising:

mixing the starting material and the reducing agent in the chute.

4. The concentrate burner of the copper smelting furnace as claimed in claim 1 further comprising:

a dispersion cone that is provided at a bottom of a lance, wherein the lance passes through the raw material supply portion and forms a passage for blowing dispersion gas for dispersing the starting material, into the copper smelting furnace, and wherein the raw material supply portion has an outlet that is opened above the dispersion cone and supplies the starting material into the reaction shaft, the starting material being mixed with the reducing agent in the raw material supply portion.

5. The concentrate burner of the copper smelting furnace as claimed in claim 1, wherein the reducing agent includes Fe metal particles of which a particle diameter is 1 mm to 10 mm.

6. The operation method as claimed in claim 3, wherein the reducing agent includes Fe metal particles of which a particle diameter is 1 mm to 10 mm.

* * * * *